US010702785B1

(12) United States Patent
Chen

(10) Patent No.: US 10,702,785 B1
(45) Date of Patent: Jul. 7, 2020

(54) MODULAR INFLATABLE OBSTACLE COURSE

(71) Applicant: Samuel Chen, Causeway Bay (HK)

(72) Inventor: Samuel Chen, Causeway Bay (HK)

( * ) Notice: Subject to any disclaimer, the term of this patent is extended or adjusted under 35 U.S.C. 154(b) by 0 days.

(21) Appl. No.: 16/386,131

(22) Filed: Apr. 16, 2019

(51) Int. Cl.
*A63G 31/12* (2006.01)
*A63K 3/04* (2006.01)
*A63B 17/04* (2006.01)

(52) U.S. Cl.
CPC ..... *A63G 31/12* (2013.01); *A63B 17/04* (2013.01); *A63B 2225/62* (2013.01); *A63K 3/04* (2013.01)

(58) Field of Classification Search
CPC ..... A63G 31/12; A63K 3/046; A63K 3/04; A63B 2225/62; A63B 17/04; A01K 15/027
USPC ..... 472/134
See application file for complete search history.

(56) References Cited

U.S. PATENT DOCUMENTS 5,372,550 A * 12/1994 Gleeson ..... A63B 9/00 472/116
7,089,703 B2 * 8/2006 Brereton ..... A63B 9/00 472/134
8,425,338 B2 * 4/2013 Gray ..... A63G 31/12 472/134
8,574,085 B1 * 11/2013 Jackson ..... A63J 11/00 472/136
9,861,901 B1 * 1/2018 Pierzynski ..... A63G 31/12
9,956,449 B2 * 5/2018 Adams ..... A63B 71/02
2007/0072690 A1 * 3/2007 Berenson ..... A63G 21/00 472/117
2009/0264042 A1 * 10/2009 Chen ..... A63G 31/007 446/221
2010/0120323 A1 * 5/2010 Boretskin ..... A63G 31/12 446/220
2012/0083350 A1 * 4/2012 Frankowski ..... A63G 31/00 472/128
2014/0295980 A1 * 10/2014 Chen ..... A63B 71/02 472/134
2015/0111655 A1 4/2015 Coleman
2018/0236370 A1 8/2018 Nadler

* cited by examiner

*Primary Examiner* — Michael D Dennis
(74) *Attorney, Agent, or Firm* — Clement Cheng

(57) ABSTRACT

A modular inflatable obstacle course includes a frame unit. The frame unit is configured to be placed adjacent to a second frame unit in a sequence with a first frame unit and a last frame unit. A constant air inflatable portion is configured to be placed adjacent to a second constant air inflatable portion with a first constant air inflatable portion and a last constant air inflatable portion. The constant air inflatable portion fits over the frame unit and is preferably strapped to the frame unit. The constant air inflatable portion is attached to the frame unit to support the constant air inflatable portion. The constant air inflatable portion covers a portion of the frame unit. An air connection such as a fabric tube is preferably formed between the frame unit and the constant air inflatable portion.

22 Claims, 6 Drawing Sheets

MODULAR INFLATABLE OBSTACLE COURSE

FIELD OF THE INVENTION

The present invention is in the field of inflatable obstacle courses.

DISCUSSION OF RELATED ART

A variety of different inflatable obstacle courses have been described in published patents. For example, United States patent publication 2018/0236370 to inventor Nadler entitled Inflatable Obstacle Course Equipment, the disclosure of which is incorporated herein by reference, published Aug. 23, 2018, discloses a variety of different configurations for inflatable devices that can be used as training equipment spaced apart on a field. Inventor Coleman in United States patent publication 2015/0111655 published Apr. 23, 2015, entitled Portable Inflatable Obstacle Course, provides an obstacle course having a base and sidewalls, the disclosure of which is incorporated herein by reference.

SUMMARY OF THE INVENTION

A modular inflatable obstacle course includes a frame unit. The frame unit is configured to be placed adjacent to a second frame unit in a sequence with a first frame unit and a last frame unit. A constant air inflatable portion is configured to be placed adjacent to a second constant air inflatable portion with a first constant air inflatable portion and a last constant air inflatable portion. The constant air inflatable portion fits over the frame unit and is preferably strapped to the frame unit. The constant air inflatable portion is attached to the frame unit to support the constant air inflatable portion. The constant air inflatable portion covers a portion of the frame unit. An air connection such as a fabric tube is preferably formed between the frame unit and the constant air inflatable portion.

The frame unit preferably has a lower frame rear section and a lower frame front section. A lower frame right section is preferably connected to the lower frame front section and the lower frame rear section, and a lower frame left section connected to the lower frame front section and the lower frame rear section, wherein the frame units further include a front right frame section, and a front left frame section, wherein the front right frame section extends upwardly from the lower frame front section, and wherein the lower frame left section extends upwardly from the lower frame front section, wherein the frame unit is attached to the constant air inflatable portions.

The frame unit further includes a front frame apex and a rear frame apex. The upper middle frame cross beam attaches the front frame apex to the rear frame apex. The constant air inflatable portion is a pool that is watertight and can receive and hold water within it. The constant air inflatable portion includes a climbing wall for a climbing wall module. The modular constant air inflatable portion includes a first trench sidewall and a second trench sidewall to form a trench module. The frame unit can form a trampoline frame for a trampoline module. The frame unit forms a cargo net frame for a cargo net module.

The constant air inflatable portion can include a climbing apex for a hill climb module. The climbing apex is formed over a hill climb base. The constant air inflatable portion also includes a climbing face reading to the climbing apex. The frame unit includes a monkey line horizontal bar for a monkey line module.

Figure 1:
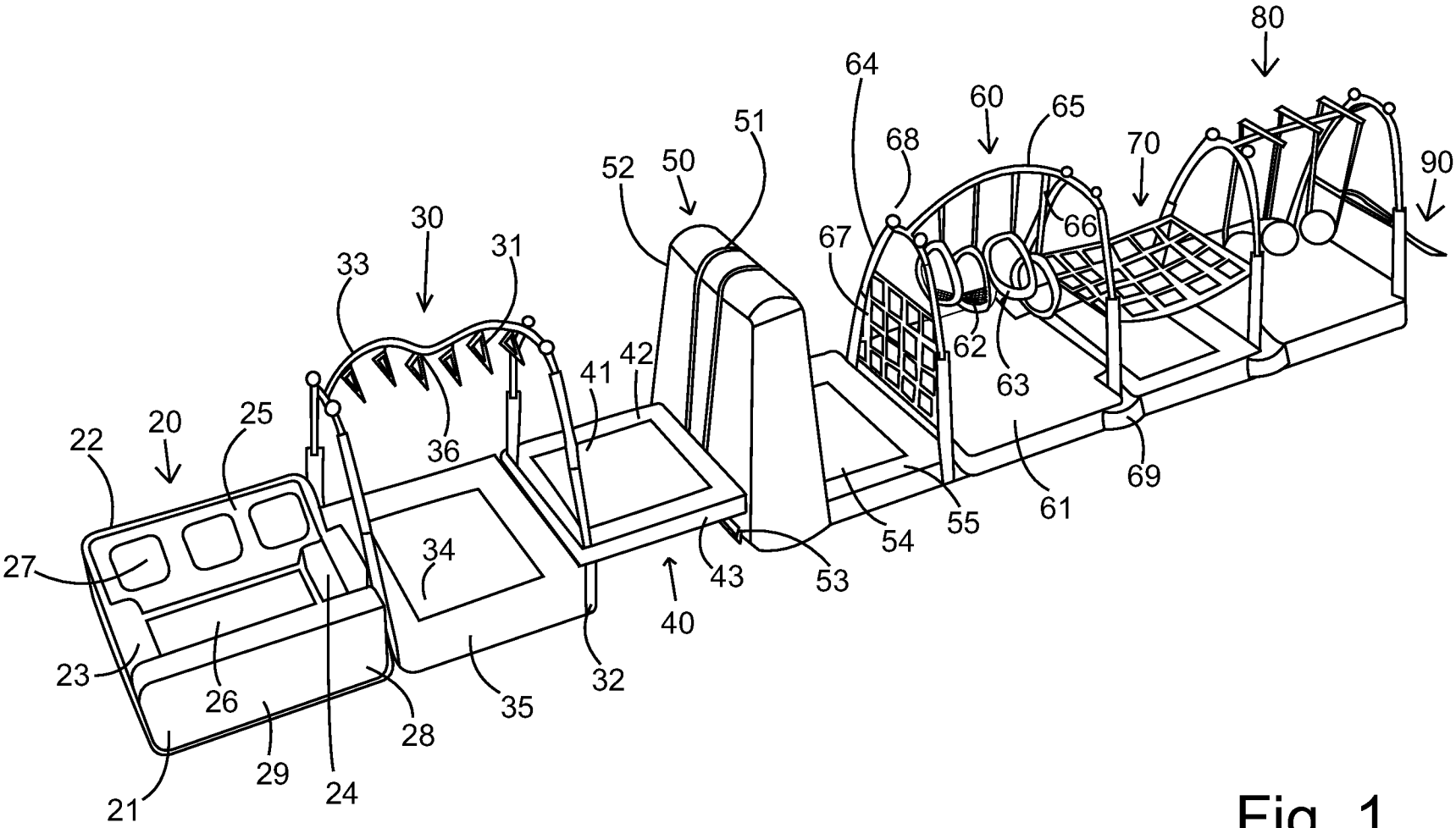
FIG. 1 is a diagram of the modules in a combined configuration.

The following call out list of elements can be useful guide in referencing the element numbers of the drawings.

20 Trench Module
21 First Trench Sidewall
22 Second Trench Sidewall
23 First Trench Landing
24 Second Trench Landing
25 Trench Sidewall Angled Inside Surface
26 Trench Pool
27 Trench Foot Pad
28 Trench Frame
29 Trench Constant Air Inflatable Portion
30 Monkey Line Module
31 Swing Bars
32 Swing Bar Frame
33 Monkey Line Horizontal Bar
34 Monkey Line Pool
35 Monkey Line Pool Sidewalls
36 Swing Bar Connector
40 Trampoline Module
41 Trampoline Bed
42 Trampoline Spring Cover
43 Trampoline Frame
44 First Sidewall Extension
45 Second Sidewall Extension
46 Climbing Wall Channel
47 Inflatable Pool Connection
48 Trampoline Handlebar
49 Trampoline Leg
50 Climbing Wall Module
51 Climbing Line
52 Inflatable Climbing Wall
53 Climbing Wall Frame
54 Climbing Wall Pool
55 Climbing Wall Pool Sidewall
56 Wall Straps
57 Upper Straps
58 Wall Ápex
60 Hoop Module
61 Hoop Module Base
62 Hoop
63 Hoop Connector
64 Hoop Module Frame
65 Hoop Module Horizontal Support
66 Hoop Line
70 Horizontal Cargo Net Module

71 Cargo Net Frame
72 Cargo Net Frame Cover
73 Horizontal Cargo Net
74 Cargo Net Connection
75 Cargo Net Pool
76 Cargo Net Pool Inflatable
77 Cargo Net Openings
80 Ball Walk Module
81 First Ball
82 Second Ball
83 Third Ball
84 Ball Walk Module Frame
85 Ball Walk Module Beam
86 Suspension Cable
87 Inflatable Notch
88 Module Frame
90 Slide Module
91 First Slide Rail
92 Second Slide Rail
93 Rail Tip
110 Hill Climb Module
111 Climbing Face
112 Climbing Apex
113 Hill Climb Base
114 Hill Climb Frame
120 Frame Unit
121 lower frame right section
122 Lower Frame Left Section
123 Lower Frame Front Section
124 Lower Frame Rear Section
125 Lower Frame Angled Section
126 Angled Panel
127 Front Left Frame Section
128 Front Right Frame Section
129 Rear Frame Section
130 Right Upper Frame Cross Beam
131 Left Upper Frame Cross Beam
132 Middle Upper Frame Cross Beam
133 Front Frame Apex
134 Front Left Apex Section
135 Front Right Apex Section
136 Rear Frame Apex
137 Rear Footing Extension
138 Front Footing Extension
139 Attachment Hangers
140 Tension Panel
141 Tension Buckle
142 Tension Snap
143 Tension Snap Anchor
144 First Hook And Loop Panel
145 Second Hook And Loop Panel
146 Flap Tip
147 Flap Joint
148 Upper Flap Edge
149 Lower Flap Edge
150 Air Connection
151 Air Connection Strap
152 Second Air Hose Base
153 First Air Hose Base
154 Sidewall Interface
160 Modules
161 First Module
162 Second Module
163 First Frame
164 Second Frame
165 First Inflatable Portion
166 Second Inflatable Portion
167 Last Module
168 Last Module Frame
169 Last Module Inflatable Portion

DETAILED DESCRIPTION OF THE PREFERRED EMBODIMENT

The present invention generally includes a plurality of modular units. Each unit has a function and is supported by a frame partially encapsulated by a cushion or pool of water. The modular units can be rearranged for maintaining novelty of the course. A variety of different physical challenges can be presented to the user such as a balance beam, walking or moving or swinging across obstacles, or trying to walk on a round ball hanging from a beam. An inflatable wall with a rope can be supported by a frame. A key feature of the present invention is that the inflatable portions are augmented by a rigid frame that can modularly interconnect to other adjacent rigid frames, and that the inflatable portions are connected to each other by air connections 150 so that the entire course can be inflated by a single air pump.

The modules 160 can be connected sequentially. A first module 161 can connect to a second module 162. A First Frame 163 can connect to a second frame 164. Similarly, a first inflatable portion 165 can structurally and through air conduit connect to a second inflatable portion 166. The course is preferably arranged in a successive sequence so that the last module 167 is connected to its adjacent module frame, and the last module frame 168 is connected to its adjacent module frame. Furthermore, the last module inflatable portion 169 is connected to its adjacent module inflatable portion. The modules 160 can be rearranged and separated into two separate obstacle courses for example.

For example, as seen in FIG. 1, a trench module 20 can have the first trench sidewall 21 and a second trench sidewall 22 on a left and right side of the trench pool 26. The trench module 20 begins at a first trench landing 23 and ends at a second trench landing 24. The first trench landing 23 and the second trench landing 24 can be made of an inflatable unit in the form of a trench constant air inflatable portion 29 that is placed over the rigid metal frame. The trench pool 26 can be filled with water. The trench sidewall angled inside surface 25 can have trench foot pads 27 that the user can bound off of to travel from the first trench landing 23 to the second trench landing 24. The trench constant air inflatable portion 29 can be filled by an air blower from a fabric flexible air hose.

The monkey line module 30 can have swing bars 31 formed in a triangular shape and hung from a monkey line horizontal bar 33 above a monkey line pool 34. The swing bar frame 32 can retain stability and rigidity of the monkey line horizontal bar 33 as well as retaining the monkey line pool 34 above the rigid metal frame of the monkey line module 30. The monkey line pool sidewalls 35 are preferably formed of a constant air inflatable portion that provides a constant air inflation to the monkey line pool 34. Each of the swing bars 31 has a swing bar connector 36 connecting the swing bar 31 to the monkey line horizontal bar 33. The monkey line horizontal bar 33 can be mounted on a pair of arches that together form the swing bar frame 32. Each of the pair of arches has a vertical column or post member that connects together to support the monkey line pool sidewalls 35. The monkey line pool sidewalls 35 cover the monkey line module rigid metal frame which can be formed as the swing bar frame 32. The swing bar frame 32 can have horizontal members that connect underneath the monkey line pool sidewalls 35 so that each bottom portion of each pair of arches is connected.

Figure 5:
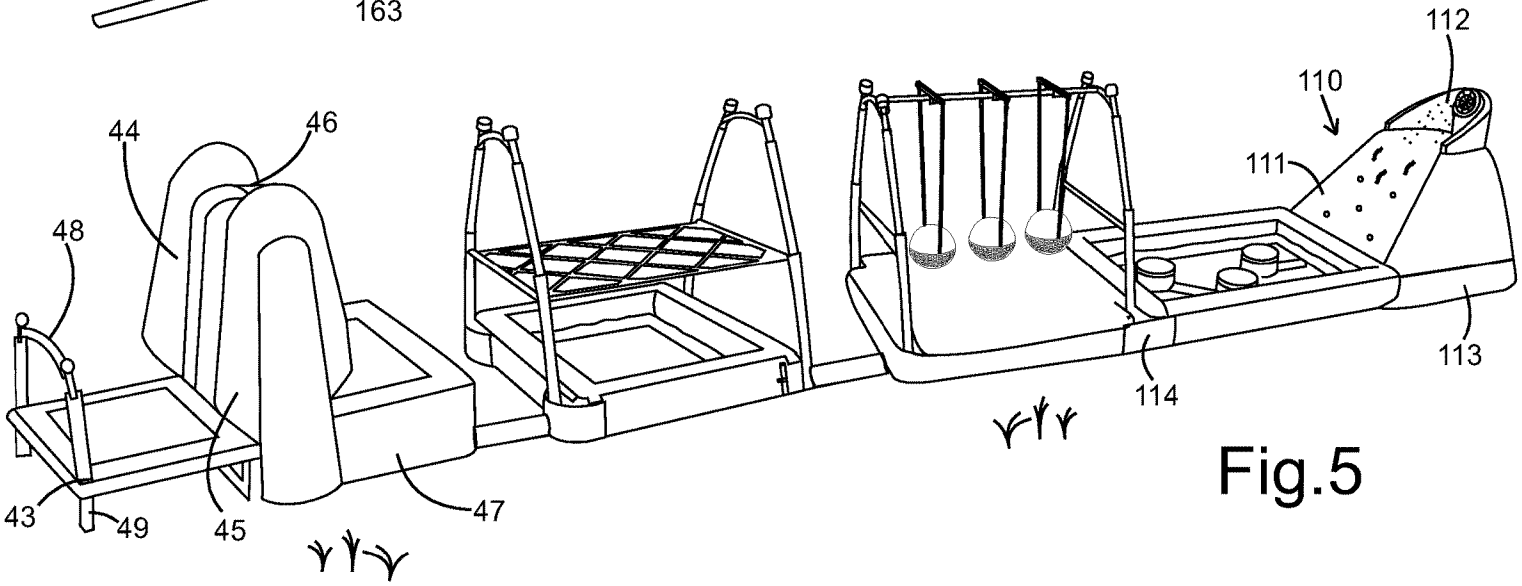
FIG. 5 is a diagram of the modules in a reorganized configuration.
Figure 6:
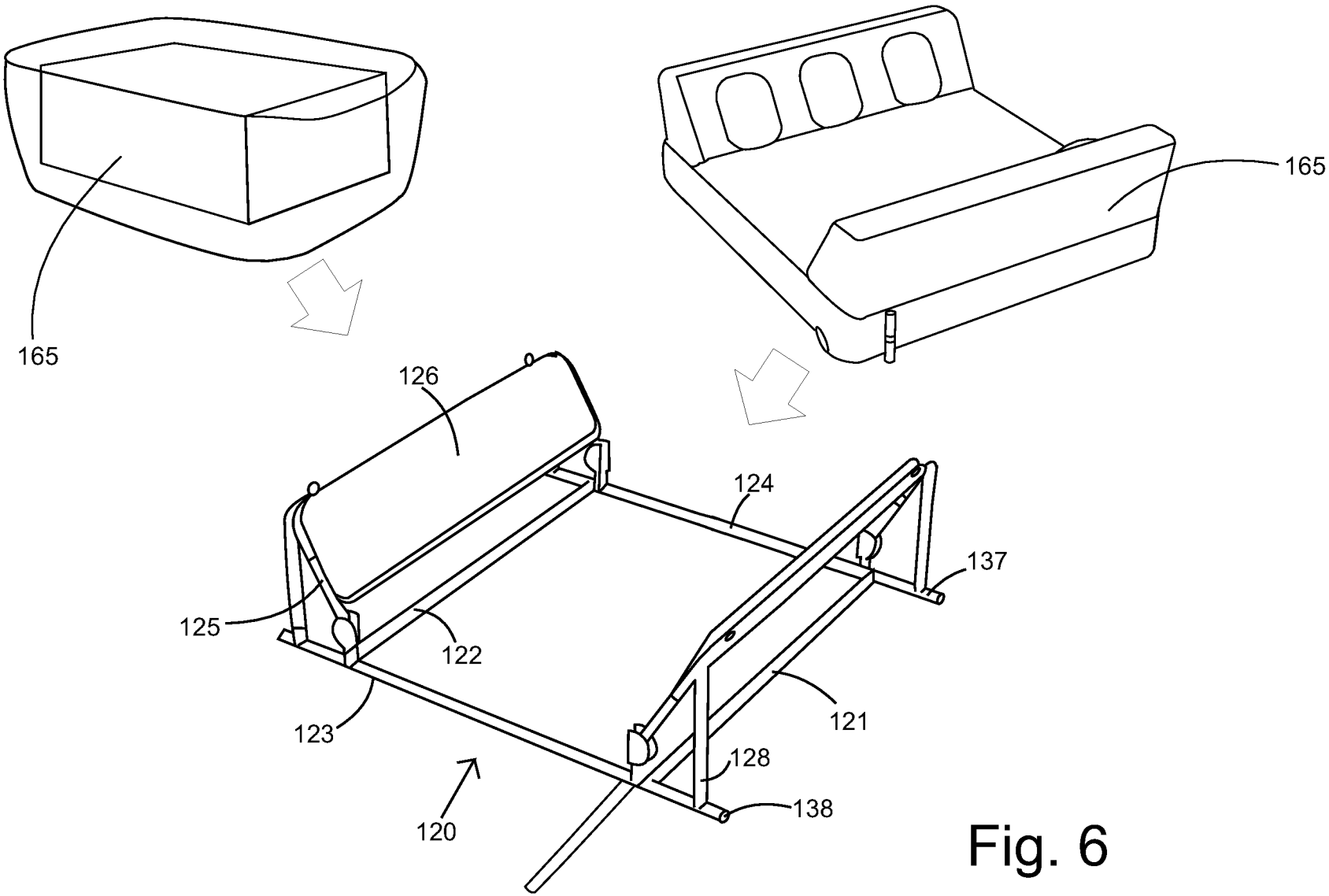
FIG. 6 is a diagram showing inflatable portion interchangeability.
Figure 8:
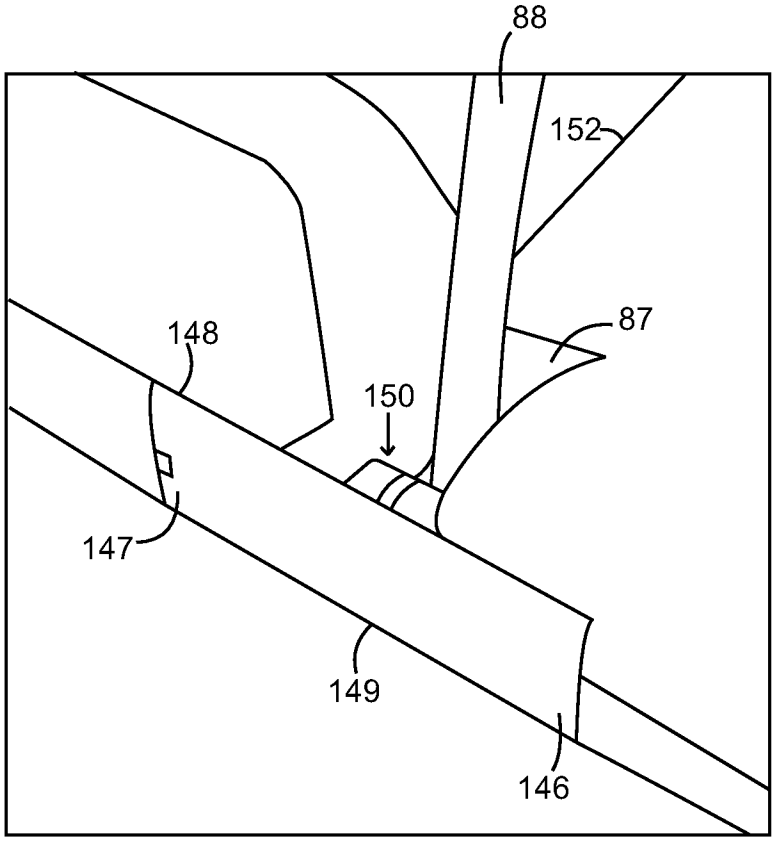
FIG. 8 is a diagram showing inflatable portion interconnection complete.

The monkey line module 30 can be connected to the trampoline module 40 with the trampoline legs 49 connected to or integrally formed with the swing bar frame 32. The trampoline module 40 preferably has a trampoline bed 41, bounded by a trampoline spring cover 42 and supported by a trampoline frame 43. The trampoline frame 43 can be rigidly connected to or integrally formed with the climbing wall frame 53. As seen in FIG. 5, the climbing wall can have the first sidewall extension 44 and a second sidewall extension 45 inflatably protruding from the sidewall of the climbing wall to form a climbing wall channel 46. The climbing wall can be connected to the inflatable pool at an inflatable pool connection 47. The first sidewall extension 44 and the second sidewall extension 45 can be connected to a trampoline leg 49. Preferably, the trampoline leg 49 extends upwardly to a horizontally oriented trampoline handlebar 48.

The trampoline module 40 can be placed adjacent to the climbing wall module 50. The climbing wall module 50 preferably includes a climbing line 51 draped over an apex of the climbing wall module 50. The climbing wall module 50 includes an inflatable climbing wall 52 placed over a climbing wall frame 53. The inflatable climbing wall 52 can be strapped to the climbing wall frame 53. The climbing wall pool 54 is preferably integrally formed with the inflatable climbing wall 52, or attached thereto. The climbing wall pool 54 preferably includes a climbing wall pool sidewall 55. The climbing wall pool sidewall 55 covers the climbing wall frame 53.

The climbing wall frame 53 can protrude from the inflatable climbing wall 52, or can be completely covered by the inflatable climbing wall 52. The climbing wall frame 53 can be rigidly connected to an adjacent module.

The hoop module as seen in the figures includes a hoop module frame 64 that includes a hoop module horizontal support 65. The hoop module horizontal support 65 retains a hoop line 66 so that each hoop 62 is suspended underneath the hoop module horizontal support 65. Each hoop 62 includes a hoop connector 63 such as a net between the hoops 62. A user can climb through the hoops from the first hoop to the second hoop. The hoop module frame 64 has a plurality of upper frame connectors 68 that connect various sections of hoop module frame 64 together. The hoop module frame 64 may also support a vertical cargo net 67 so that the user climbs up the vertical cargo net 67 before climbing through the hoops 62. The hoop module base 61 is preferably an inflatable member that supported by the hoop module frame 54. The hoop module base may have a rectangular steel tubular frame underneath it.

The cargo net module 70 can be modularly attached to the hoop module 60. Similarly, the ball walk module 90 can be attached to the cargo net module 70. A slide module 90 can be optionally attached to the ball walk module 80.

Figure 2:
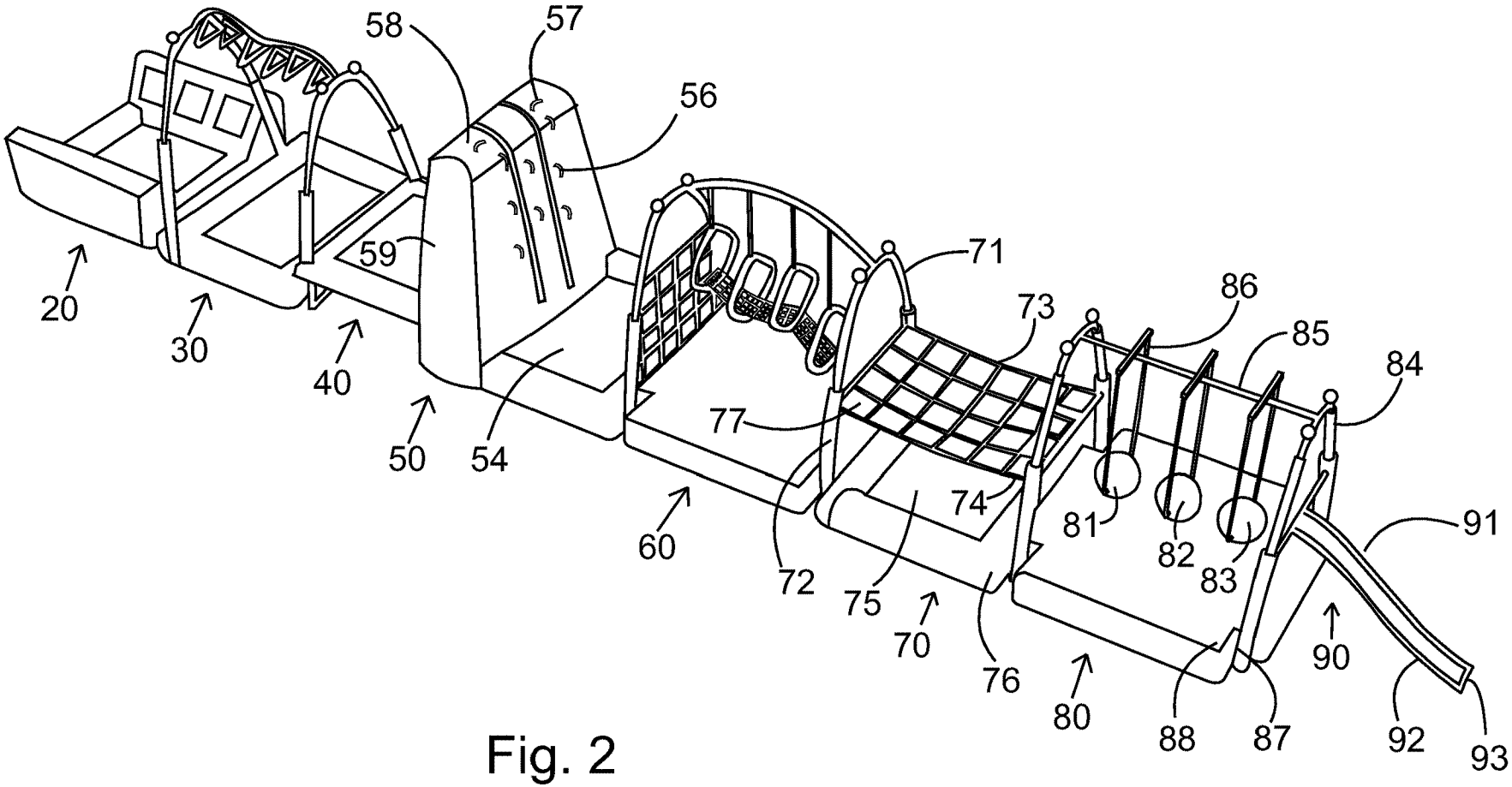
FIG. 2 is a diagram of the modules in a combined configuration.

As seen in FIG. 2, cargo net module 70 has a cargo net frame 71 that supports a horizontal cargo net 73. The cargo net frame 71 may have a cargo net frame cover 72. The cargo net connection 74 connects the horizontal cargo net 73 to the cargo net frame 71 to provide a suspension above a cargo net pool 75. The cargo net pool 75 can be filled with water. The horizontal cargo net 73 has a number of cargo net openings 77 that a user climbs over. The cargo net frame 71 is preferably covered by the cargo net pool 75 to protect against user falls, and also for providing a stable weighted ballast. The cargo net frame 71 can be comprised of a pair of arches over a rectangular metal tubular frame portion.

The ball walk module 80 has a first ball 81, a second ball 82, and a third ball 83 suspended from the ball walk module frame 84. The ball walk module frame 84 has a ball walk module beam 85 from which the balls are suspended by suspension cables 86. The suspension cables 86 can attach to the left and right side of each ball. The user can walk over the balls between the suspension cables. The module frame 88 can have a frame sheathing 89 that fits over the module frame 88. The inflatable portion preferably has an inflatable notch 87 cut into the inflatable portion that is placed underneath the balls. A user can balance on the soft surface of the balls.

Figure 4:
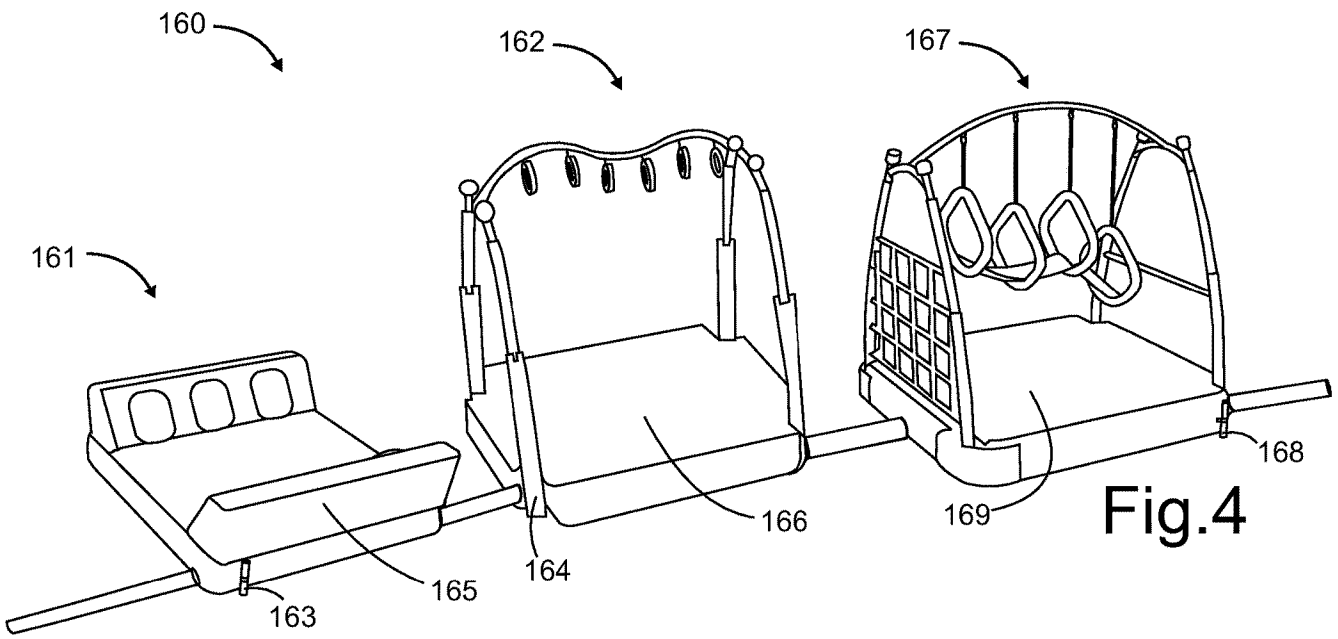
FIG. 4 is a diagram of the modules in a reorganized configuration.

A rail 90 can be connected to the ball walk module frame 84 of the ball walk module 80. The rail can include a first slide rail 91 and a second slide rail 92 connected together at a rail tip 93. The pair of rails can provide an obstacle for user to climb over. Instead of a rail to climb, the end of the obstacle course can be a hill climb module 110 as seen in FIG. 4.

Figure 3:
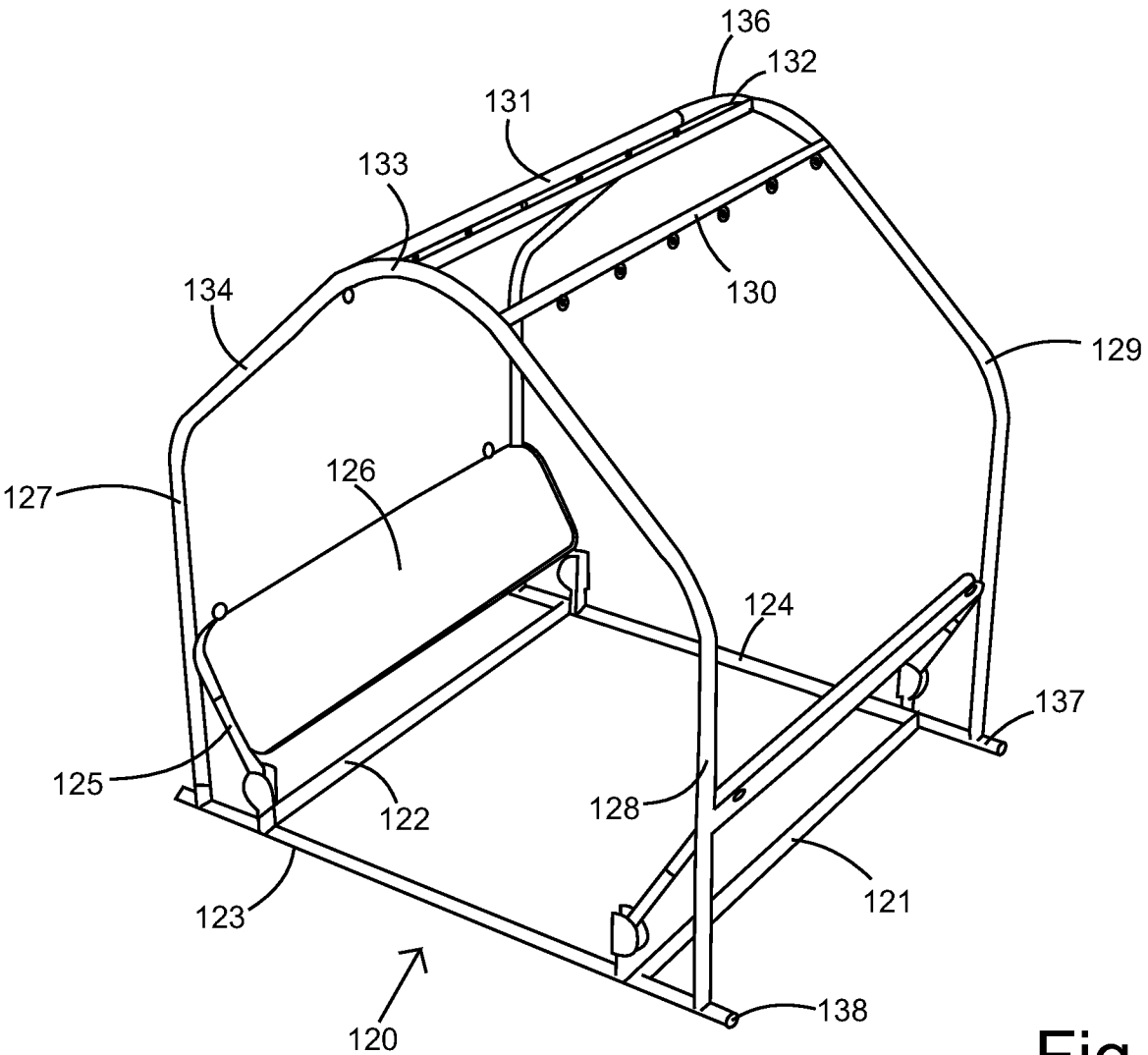
FIG. 3 is a diagram of the frame unit.

As seen in FIG. 3, the frame unit 120 has a rectangular bottom stability section which includes a lower frame right section 121, and a lower frame left section 122 connected together by a lower frame front section 123 and a lower frame rear section 124. The rectangular bottom stability section of each module can connect with the rectangular bottom stability section of the next module, for example by strapping the lower frame front sections together. Optionally, the lower frame front section 123 can extend on a left and right side at front footing extensions 138. The front footing extensions 138 of adjacent modules can be strapped by rope, table, hook and loop tape straps or can be rigidly connected by bolts for example to the rear footing extensions 137 of adjacent modules. The lower frame rear section 124 of a module can be strapped or connected to the lower frame front section 123 of the adjacent module. The rear frame section 129 and the front frame section both extend upwardly from the rectangular bottom stability section. The front frame section includes a front left frame section 127, and a front right frame section 128. The front left frame section 127 extends upwardly to a front left apex section 134, and the front right frame section 128 extends upwardly to a front right apex section 135. The front left apex section 134 connects to the front right apex section 135 at a front frame apex 133. The front frame apex 133 connects to the rear frame apex 136 at a left upper frame cross beam and at a right upper frame cross beam 130. The right upper frame cross beam 130 and the left upper frame cross beam 131 can have attachment hangers 139 for attaching obstacles such as hoops and nets. Additionally, the middle upper frame cross beam 132 may connect the rear frame apex 136 to the front frame apex 133.

The lower frame angled section 125 supports the angled panel 126 above the lower frame left section 122 and the lower frame right section 121. The angled panel 126 can form an angled surface for receiving an inflatable cover. The angled panel 126 can form an angled profile for the trench footpad 27, or the trench sidewall angled inside surface 25. The middle upper frame cross beam 132 can provide a horizontal bar to support a monkey line horizontal bar 33 for example, or a hoop module horizontal support 65. The balls of the ball walk module 80 can be supported by an upper left frame cross beam 131 or an upper right frame cross beam 130.

The framing unit 120 can be adapted in a variety of different manners by omitting one or more of the elements to form the rigid frame of the module.

Figure 7:
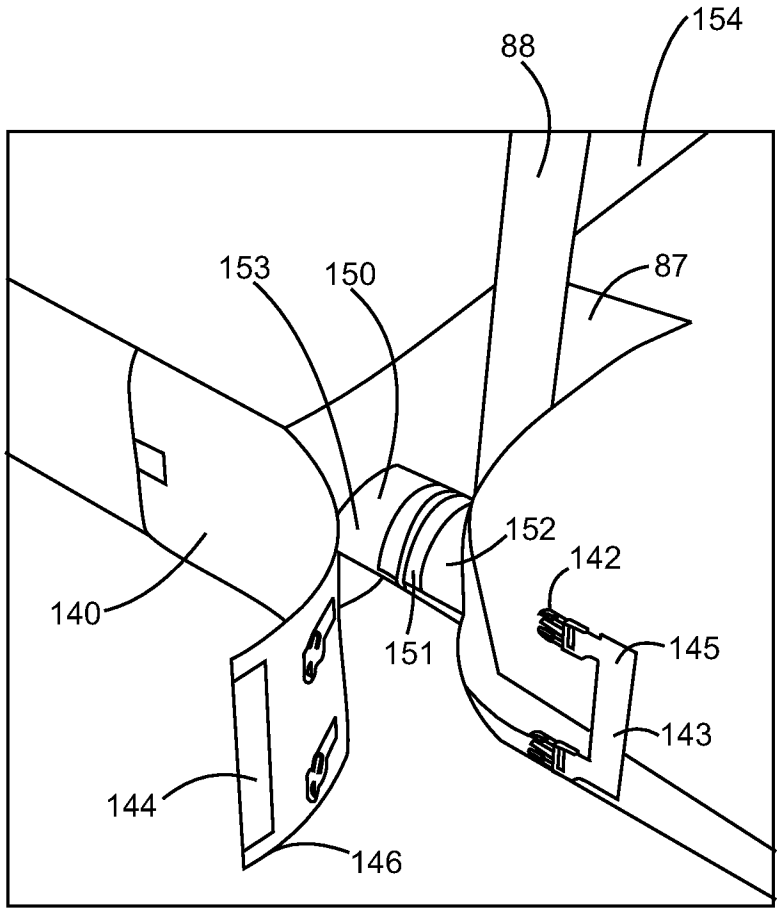
FIG. 7 is a diagram showing inflatable portion interconnection.

As seen in FIG. 4, the modules can be spaced apart and individually located to provide a distance between modules, or can be combined together as seen in FIGS. 1-2. The modules may have a connection or separated construction but are preferably connected together. As seen in FIG. 7, and air connection 150 can connect airflow between adjacent inflatable portions of modules. A first module having a first air hose base 153 can connect to a second module having a second air hose base 152. An inflatable notch 87 provides an opening for a vertically oriented module frame 88 the module frame 88 has module sheathing 89, however the module frame 88 also has an inflatable cover over it. The inflatable cover from one module is preferably connected to an inflatable cover of an adjacent module. The air connection 150 provides air pressure and fluid flow between the first module and the second module. The inflatable notch 87 forms a gap between adjacent modules. The gap is preferably closed using a flap.

A sidewall interface 154 is a portion of the inflatable parts that abut each other along an inside portion of the inflatable covers, however at a distal portion, the inflatable notch 87 is preferably closed. The tension panel 140 has a tension buckle 141 that connects to a tension strap 142. The tension strap 142 is attached to the adjacent module and has a tension strap anchor 143 that is attached to the adjacent module. The first hook and loop panel 144 can attach a flap tip 146 to a second hook and loop panel 145. Additionally, and air connection 150 can be secured by an air connector strap 151 which can also be a hook and loop strap. After being closed, the tension panel is shown with a flap joint 147 on a left side, and a flap tip 146 on a right side.

An upper flap edge 148 is parallel and at a higher level than a lower flap edge 129. The upper flap edge covers the air connection 150 so that users running along an edge of the inflatable portion do not dislodge the air connection 150. Also, the tension panel 140 provides an additional structural connection between modules. The vertical oriented module frame 88 can form a rigid portion of a module.

The invention claimed is:

1. A modular inflatable obstacle course comprising:

two or more sequentially positioned modular units capable of being rearranged, wherein the two or more modular units comprise:

a first modular unit comprising:

a first rigid frame unit, a first constant air inflatable portion, wherein the first constant air inflatable portion fits over the first frame unit, wherein the first constant air inflatable portion is supported by the first frame unit, wherein the first constant air inflatable portion at least partially encapsulates a portion of the first frame unit; and a first air connection formed on the first constant air inflatable portion; and a second modular unit comprising:

a second rigid frame unit, a second constant air inflatable portion, wherein the second constant air inflatable portion fits over the second frame unit, wherein the second constant air inflatable portion is supported by the second frame unit, wherein the second constant air inflatable portion at least partially encapsulates a portion of the second frame unit: wherein the second constant air inflatable portion is different from the first constant air inflatable portion, and a second air connection on the second constant air inflatable portion;

wherein the first rigid frame unit and second rigid frame unit are modularly interconnectable;

wherein the first constant air inflatable portion and second constant air inflatable portion are connected by air connection;

wherein the first constant air inflatable portion and second constant air inflatable portion are interchangeable; and wherein the second frame unit further includes a lower frame rear section, a lower frame front section, a lower frame right section connected to the lower frame front section and the lower frame rear section, and a lower frame left section connected to the lower frame front section and the lower frame rear section, wherein the second frame unit further includes a front right frame section, and a front left frame section, wherein the front right frame section extends upwardly from the lower frame front section, and wherein the lower frame left section extends upwardly from the lower frame front section, wherein the second frame unit is attached to the second constant air inflatable portion.

2. The modular inflatable obstacle course of claim 1, wherein the first frame unit further includes a lower frame rear section, a lower frame front section, a lower frame right section connected to the lower frame front section and the lower frame rear section, and a lower frame left section connected to the lower frame front section and the lower frame rear section, wherein the first frame unit further includes a front right frame section, and a front left frame section, wherein the front right frame section extends upwardly from the lower frame front section, and wherein the lower frame left section extends upwardly from the lower frame front section, wherein the first frame unit is attached to the first constant air inflatable portion.

3. The modular inflatable obstacle course of claim 1, wherein the first frame unit further includes a front frame apex and a rear frame apex, wherein an upper middle frame cross beam attaches the front frame apex to the rear frame apex.

4. The modular inflatable obstacle course of claim 1, wherein the first constant air inflatable portion includes a first trench sidewall and a second trench sidewall to form a trench module.

5. The modular inflatable obstacle course of claim 1, wherein the second constant air inflatable portion is a pool that is watertight and can receive and hold water within it.

6. The modular inflatable obstacle course of claim 1, further comprising a third modular unit, wherein the third modular unit comprises a third constant air inflatable portion that includes a climbing wall.

7. The modular inflatable obstacle course of claim 1, further comprising a third modular unit, wherein the third modular unit comprises a third frame unit that forms a trampoline frame for a trampoline module.

8. The modular inflatable obstacle course of claim 1, further comprising a third modular unit, wherein the third modular unit comprises a third frame unit that forms a cargo net frame for a cargo net module.

9. The modular inflatable obstacle course of claim 1, further comprising a third modular unit, wherein the third modular unit comprises a third constant air inflatable portion comprising a climbing apex for a hill climb module, wherein the climbing apex is formed over a hill climb base, wherein the third constant air inflatable portion also includes a climbing face leading to the climbing apex.

10. The modular inflatable obstacle course of claim 1, further comprising a third modular unit, wherein the third modular unit comprises a third frame unit, wherein the third frame unit includes a monkey line horizontal bar for a monkey line module.

11. The modular inflatable obstacle course of claim 1, wherein the second frame unit further includes a front frame apex and a rear frame apex, wherein an upper middle frame cross beam attaches the front frame apex to the rear frame apex.

12. A modular inflatable obstacle course comprising:

two or more sequentially positioned modular units capable of being rearranged, wherein the two or more modular units comprise:

a first modular unit comprising:

a first rigid frame unit, a first constant air inflatable portion, wherein the first constant air inflatable portion fits over the first frame unit, wherein the first constant air inflatable portion is supported by the first frame unit, wherein the first constant air inflatable portion at least partially encapsulates a portion of the first frame unit; and a first air connection formed on the first constant air inflatable portion; and a second modular unit comprising:

a second rigid frame unit, a second constant air inflatable portion, wherein the second constant air inflatable portion fits over the second frame unit, wherein the second constant air inflatable portion is supported by the second frame unit, wherein the second constant air inflatable portion at least partially encapsulates a portion of the second frame unit; wherein the second constant air inflatable portion is different from the first constant air inflatable portion, and a second air connection on the second constant air inflatable portion;

wherein the first rigid frame unit and second rigid frame unit are modularly interconnectable;

wherein the first constant air inflatable portion and second constant air inflatable portion are connected by air connection; and wherein the first constant air inflatable portion and second constant air inflatable portion are interchangeable.

13. The modular inflatable obstacle course of claim 12, wherein the first frame unit further includes a lower frame rear section, a lower frame front section, a lower frame right section connected to the lower frame front section and the lower frame rear section, and a lower frame left section connected to the lower frame front section and the lower frame rear section, wherein the first frame unit further includes a front right frame section, and a front left frame section, wherein the front right frame section extends upwardly from the lower frame front section, and wherein the lower frame left section extends upwardly from the lower frame front section, wherein the first frame unit is attached to the first constant air inflatable portion.

14. The modular inflatable obstacle course of claim 12, wherein the first frame unit further includes a front frame apex and a rear frame apex, wherein an upper middle frame cross beam attaches the front frame apex to the rear frame apex.

15. The modular inflatable obstacle course of claim 12, wherein the first constant air inflatable portion includes a first trench sidewall and a second trench sidewall to form a trench module.

16. The modular inflatable obstacle course of claim 12, wherein the second constant air inflatable portion is a pool that is watertight and can receive and hold water within it.

17. The modular inflatable obstacle course of claim 12, further comprising a third modular unit, wherein the third modular unit comprises a third constant air inflatable portion that includes a climbing wall.

18. The modular inflatable obstacle course of claim 12, further comprising a third modular unit, wherein the third modular unit comprises a third frame unit that forms a trampoline frame for a trampoline module.

19. The modular inflatable obstacle course of claim 12, further comprising a third modular unit, wherein the third modular unit comprises a third frame unit that forms a cargo net frame for a cargo net module.

20. The modular inflatable obstacle course of claim 12, further comprising a third modular unit, wherein the third modular unit comprises a third constant air inflatable portion comprising a climbing apex for a hill climb module, wherein the climbing apex is formed over a hill climb base, wherein the third constant air inflatable portion also includes a climbing face leading to the climbing apex.

21. The modular inflatable obstacle course of claim 12, further comprising a third modular unit, wherein the third modular unit comprises a third frame unit, wherein the third frame unit includes a monkey line horizontal bar for a monkey line module.

22. The modular inflatable obstacle course of claim 12, wherein the second frame unit further includes a front frame apex and a rear frame apex, wherein an upper middle frame cross beam attaches the front frame apex to the rear frame apex.

* * * * *